US009673001B2

(12) United States Patent
Ho et al.

(10) Patent No.: US 9,673,001 B2
(45) Date of Patent: Jun. 6, 2017

(54) ROTARY SWITCH

(71) Applicants: SOLTEAM ELECTRONICS (DONG GUAN) CO., LTD., DongGuan/GunagDong (CN); SOLTEAM ELECTRONICS (SU ZHOU) CO., LTD., Wu Jiang/Jiangsu (CN); Solteam Electronics Co., Ltd., Taoyuan (TW)

(72) Inventors: Ying-Sung Ho, Taoyuan (TW); Chien-Man Chen, Taoyuan (TW); Chi-Meng Phang, Taoyuan (TW); Chih-Wei Chen, Taoyuan (TW)

(73) Assignees: SOLTEAM ELECTRONICS (DONG GUAN) CO., LTD. (CN); SOLTEAM ELECTRONICS (SU ZHOU) CO., LTD. (CN); SOLTEAM ELECTRONICS CO., LTD. (TW)

( * ) Notice: Subject to any disclaimer, the term of this patent is extended or adjusted under 35 U.S.C. 154(b) by 0 days.

(21) Appl. No.: 14/700,142

(22) Filed: Apr. 30, 2015

(65) Prior Publication Data

US 2016/0322181 A1 Nov. 3, 2016

(51) Int. Cl.

| | |
|---|---|
| ***H01H 9/02*** | (2006.01) |
| ***H01H 13/04*** | (2006.01) |
| ***H01H 19/04*** | (2006.01) |
| ***H01H 21/04*** | (2006.01) |
| ***H01H 19/20*** | (2006.01) |

(Continued)

(52) U.S. Cl.

CPC ..... *H01H 19/20* (2013.01); *H01H 19/03* (2013.01); *H01H 19/08* (2013.01); *H01H 19/11* (2013.01); *H01H 19/585* (2013.01); *H01H 19/04* (2013.01)

(58) Field of Classification Search

CPC ..... H03K 2217/94073; H03K 2217/96066; H01H 1/00; H01H 1/06; H01H 3/00; H01H 3/02; H01H 3/08; H01H 3/54; H01H 13/00; H01H 13/14; H01H 13/22; H01H 13/26; H01H 13/50; H01H 2003/02; H01H 2003/12; H01H 2201/004; H01H 2205/00; H01H 2205/002; H01H 2205/004; H01H 2221/01; H01H 2223/01; H01H 2223/012; H01H 2223/028; H01H 2231/012; H01H 2231/016; H01H 9/00; H01H 19/02; H01H 2003/0293; H01H 2239/066; H01H 19/20;

(Continued)

(56) References Cited

U.S. PATENT DOCUMENTS 4,724,286 A * 2/1988 Cummins ..... H01H 3/0213 200/11 R

2005/0258022 A1* 11/2005 Horton ..... H01H 19/11 200/11 R

* cited by examiner

*Primary Examiner* — Anthony R. Jimenez

(57) ABSTRACT

Differing from the conventional rotary switches, a rotary switch provided by the present invention is design to perform bidirectional rotation by double shaft, such that this rotary switch has the maximum switching levels of 32. Particularly, two retaining members having a spring accommodating trough are adopted for accommodating the compression springs; therefore, when switching the rotary switch from one switching level to another one switching level, each the retaining member does ensured to fully embed into one of the rotary grooves formed around the disk side edge of the corresponding rotary disks; the reason is that the compression springs suffer to pressing force would not bend during switching the novel rotary switch, such that the functions of the electric product can be switch smoothly and completely.

9 Claims, 11 Drawing Sheets

(51) Int. Cl.

| | |
|---|---|
| ***H01H 19/03*** | (2006.01) |
| ***H01H 19/08*** | (2006.01) |
| ***H01H 19/11*** | (2006.01) |
| ***H01H 19/58*** | (2006.01) |

(58) Field of Classification Search

CPC ..... H01H 19/03; H01H 19/08; H01H 19/11; H01H 19/585; H01H 19/04

USPC ..... 200/4, 11 R, 5 E, 13, 14, 11 C, 19.07, 200/19.08, 19.18, 296, 336, 303, 564, 200/565, 567, 569, 573, 245

See application file for complete search history.

ROTARY SWITCH

BACKGROUND OF THE INVENTION

1. Field of the Invention

The present invention relates to the technology field of switch units, and more particularly to a rotary switch.

2. Description of the Prior Art

Rotary switches are often applied to electric equipment, especially for electric equipment with multistage functions, such as electric fans, lamps, washing machines etc. In addition, rotary switches can switch between multistage functions of the electric equipment by using an adjust button of the rotary switch.

Please refer to FIG. 1 and FIG. 2, where an exploded view and a stereo view of a conventional rotary switch are shown. As shown in FIG. 1 and FIG. 2, the conventional rotary switch 1' consists of: an upper casing 10A', a lower casing 10B', a rotary unit 2', a substrate 3', a rotary retaining element 4', two springs 5', and a switch unit 6'; wherein the upper casing 10A' and the lower casing 10B' are provided with a first opening 11' and a second opening 12', respectively.

The rotary unit 2', disposed between the upper casing 10A' and the lower casing 10B', is consisted of a rotary body 20', a rotary disk 22', a cam 21', and a conductive member 23'. As FIG. 1 shows, the top of the cam 21' is connected to the lower end of the rotary body 20' via a through hole 31' on the substrate 3', and the bottom of the cam 21' is embedded into the second opening 12' of the lower casing 10B'. Moreover, the top end of the rotary body 20' passes through the first opening 11' so as to protrude out of the upper casing 10A'. For being suffering to the acting force from the springs 5', the rotary retaining element 4' props the rotary disk 22' by embedding into any one rotary grooves 220' formed around the side edge of the rotary disk 22'; so that, since the rotary disk 22' is propped and retained by the rotary retaining element 4', the two conductive protrusions 230' of the conductive members 23' would respectively electrically connect with two of a plurality of electrically-connecting regions 30' formed on the substrate 3'.

Referring to FIG. 1 and FIG. 2 again, by the interlocking of at least one first lock member 100' of the upper casing 10A' and the second lock member 101' of the upper casing 10B', a switch housing is therefore formed so as to accommodate the rotary unit 2', the substrate 3', the rotary retaining element 4', the springs 5'. Besides, the switch unit 6' is attached to the bottom surface of the switch housing through the clamping of the two unit fixing members 104'.

Although the rotary switch 1' shown in FIG. 1 and FIG. 2 has been widely used in various electric products, this conventional rotary switch 1' has revealed some drawbacks and shortcomings in practical use; wherein the drawbacks and shortcomings showed by the rotary switch 1' are as follows:

(1) Because the rotary switch 1' is design to perform unidirectional rotation by single shaft, the maximum switching levels for the rotary switch 1' merely reach to 16 levels. For some particular electric products, such rotary switch 1' is still lack of enough switching levels.

(2) As FIG. 1 shows, the rotary body 20' would rotate by an angle (for instance, 20°) when switching the rotary switch 1' from one switching level to another one switching level, such that the rotary retaining element 4' escapes out of one rotary grooves 220' and subsequently embeds into another one rotary grooves 220'. However, since the rotary retaining element 4' is embedded into the rotary grooves 220' due to the acting force provided by the springs 5', the rotary retaining element 4' may not fully embed into the rotary grooves 220' if the springs 5' provides an uneven acting force to the rotary retaining element 4'; that would cause the conductive protrusions 230 of the conductive members 23 unable to precisely connect with two of a plurality of electrically-connecting regions 30' formed on the substrate 3', thereafter the functions of the electric product may not be switch smoothly and completely.

Accordingly, in view of the conventional rotary switch 1' still include drawbacks, the inventor of the present application has made great efforts to make inventive research thereon and eventually provided a nanoparticle manufacturing system.

SUMMARY OF THE INVENTION

The primary objective of the present invention is to provide a rotary switch. Differing from the conventional rotary switches, the rotary switch provided by the present invention is design to perform bidirectional rotation by double shaft, such that this rotary switch has the maximum switching levels of 32. Particularly, two retaining members having a spring accommodating trough are adopted for accommodating the compression springs; therefore, when switching the rotary switch from one switching level to another one switching level, each the retaining member does ensured to fully embed into one of the rotary grooves formed around the disk side edge of the corresponding rotary disks; the reason is that the compression springs suffer to pressing force would not bend during switching the rotary switch, such that the functions of the electric product can be switch smoothly and completely.

Accordingly, in order to achieve the primary objective of the present invention, the inventor of the present invention provides a rotary switch, comprising:

a main covering body, having an internal accommodating trough, and a shaft sleeve being extended out from a top of the main covering body;

a hollow external shaft, being disposed in the internal accommodating trough, and a first top end of the hollow external shaft extending out of the main covering body along the shaft sleeve;

a first rotary disk, being connected to a first lower end of the hollow external shaft, and a plurality of first rotary grooves being formed around a disk side edge of the first rotary disk;

a first retaining member, having a first spring accommodating trough for receiving a first spring; wherein the first retaining member is able to embed into any one of the plurality of first rotary grooves, so as to prop and retain the first rotary disk based on a support of a first acting force provided by the first spring;

a first metal spring, having a first disposing portion and a plurality of first electrical contacting portions, wherein the first disposing portion is attached onto a bottom surface of the first rotary disk, and each of the plurality of first electrical contacting portions extending downward from the first disposing portion at a first tilt angle;

an inner shaft, being disposed in the hollow external shaft, and a second top end of the inner shaft extending out of the main covering body along the hollow external shaft and the shaft sleeve;

a second rotary disk, being connected to a second lower end of the inner shaft, and a plurality of second rotary grooves being formed around a disk side edge of the second rotary disk;

a second retaining member, having a second spring accommodating trough for receiving a second spring; wherein the second retaining member is able to embed into any one of the plurality of second rotary grooves, so as to prop and retain the second rotary disk based on a support of a second acting force provided by the second spring;

a second metal spring, having a second disposing portion and a plurality of second electrical contacting portions, wherein the second disposing portion is attached onto a top surface of the second rotary disk, and the second electrical contacting portions upward extending out from the second disposing portion at a second tilt angle;

a double-sided printed circuit board (PCB), wherein a plurality of first electrical connecting areas and a plurality of second electrical connecting areas are formed on a top surface and a bottom surface of the double-sided PCB, and a center through hole and an electrical connecting region being further provided on the double-sided PCB, such that the second lower end of the inner shaft sleeved the center through hole, so as to make the double-sided PCB between the first rotary disk and the second rotary disk; and a lower cover, being combined with the main covering body for shielding the internal accommodating trough; wherein the main covering body and the lower cover constitute a switch housing, and the switch housing having an exposing aperture for exposing the electrical connecting region, such that an external conductive wire set can be connected to the electrical connecting region.

BRIEF DESCRIPTION OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE PREFERRED EMBODIMENTS

To more clearly describe a rotary switch according to the present invention, embodiments of the present invention will be described in detail with reference to the attached drawings hereinafter.

Figure 3:
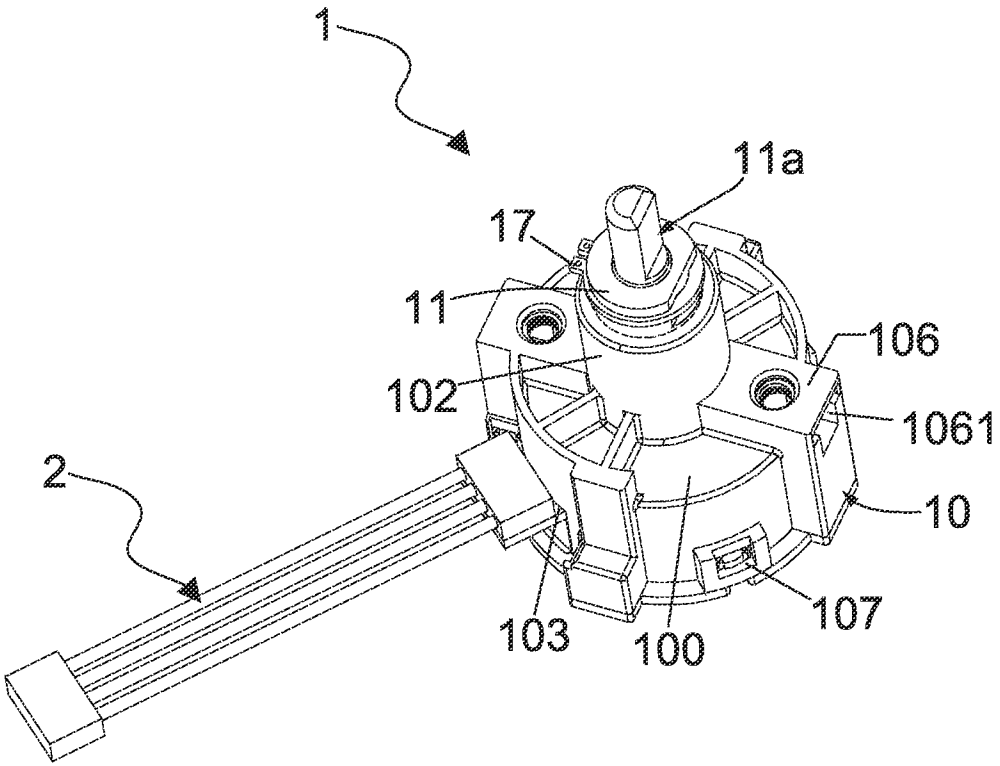
FIG. 3 and FIG. 4 are stereo diagrams of a rotary switch according to the present invention.
Figure 4:
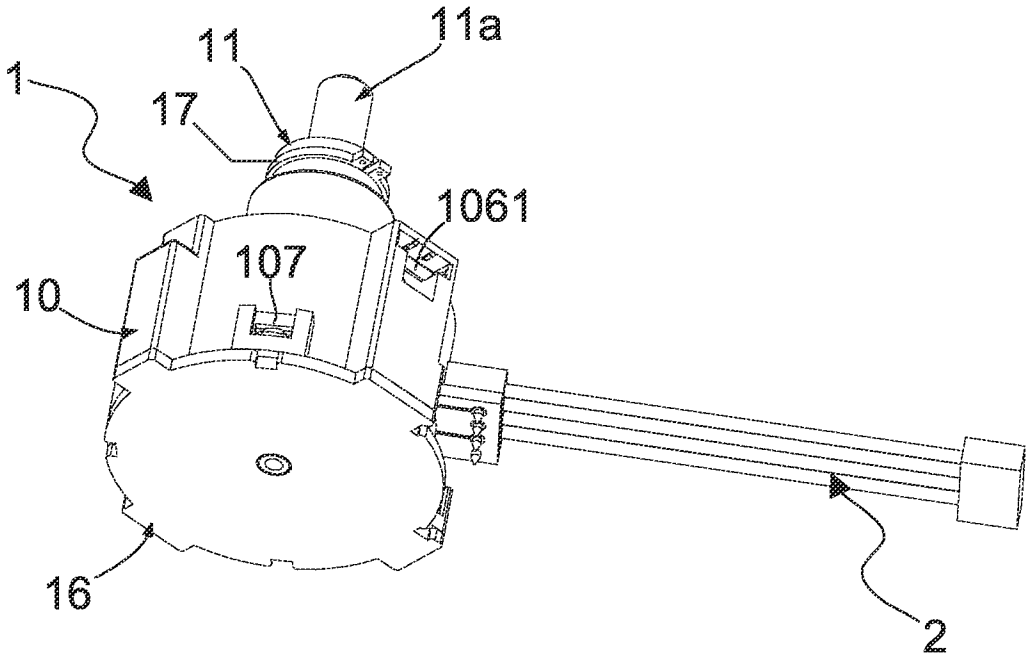
Figure 5:
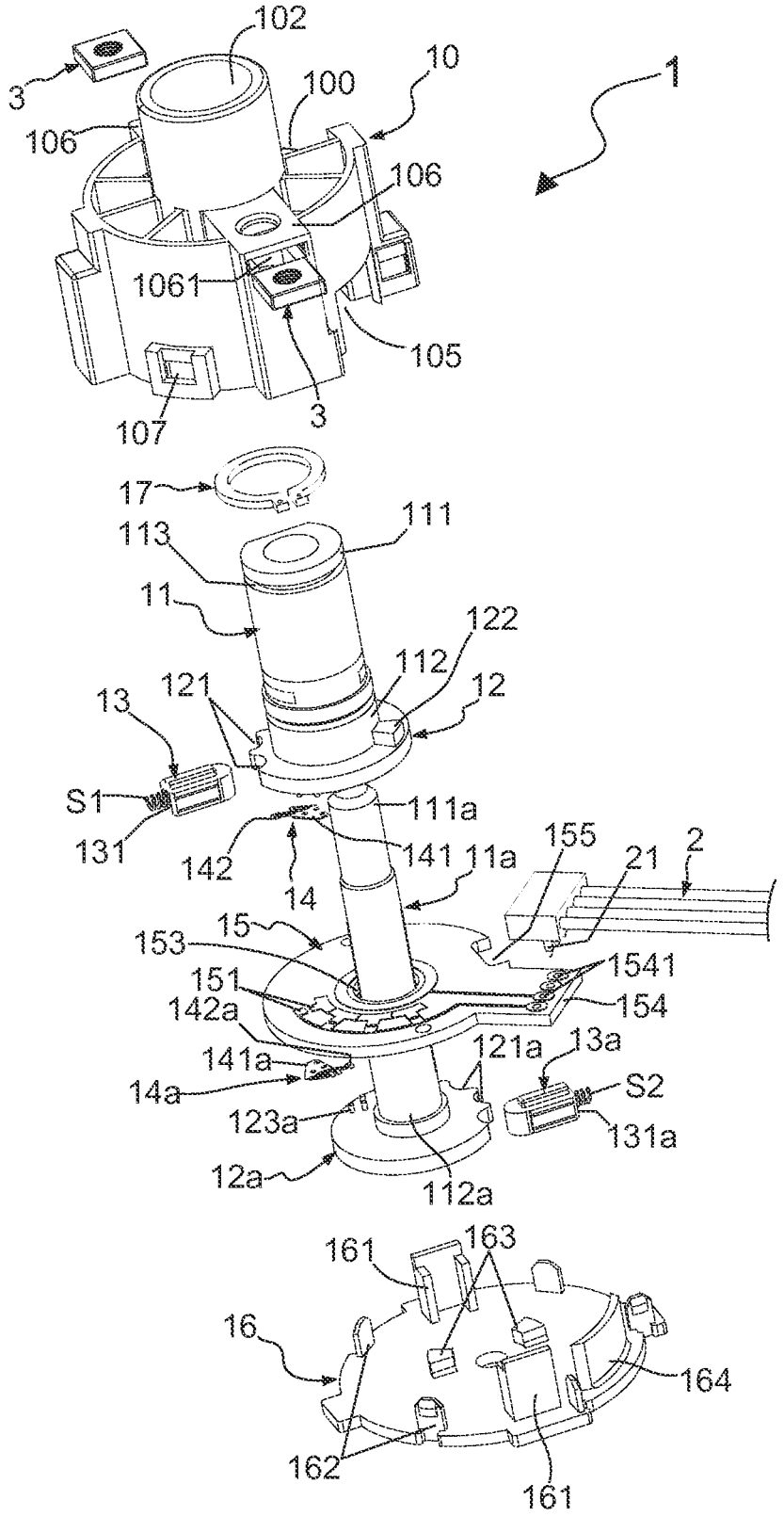
FIG. 5 and FIG. 6 are exploded diagrams of a rotary switch according to the present invention.
Figure 6:
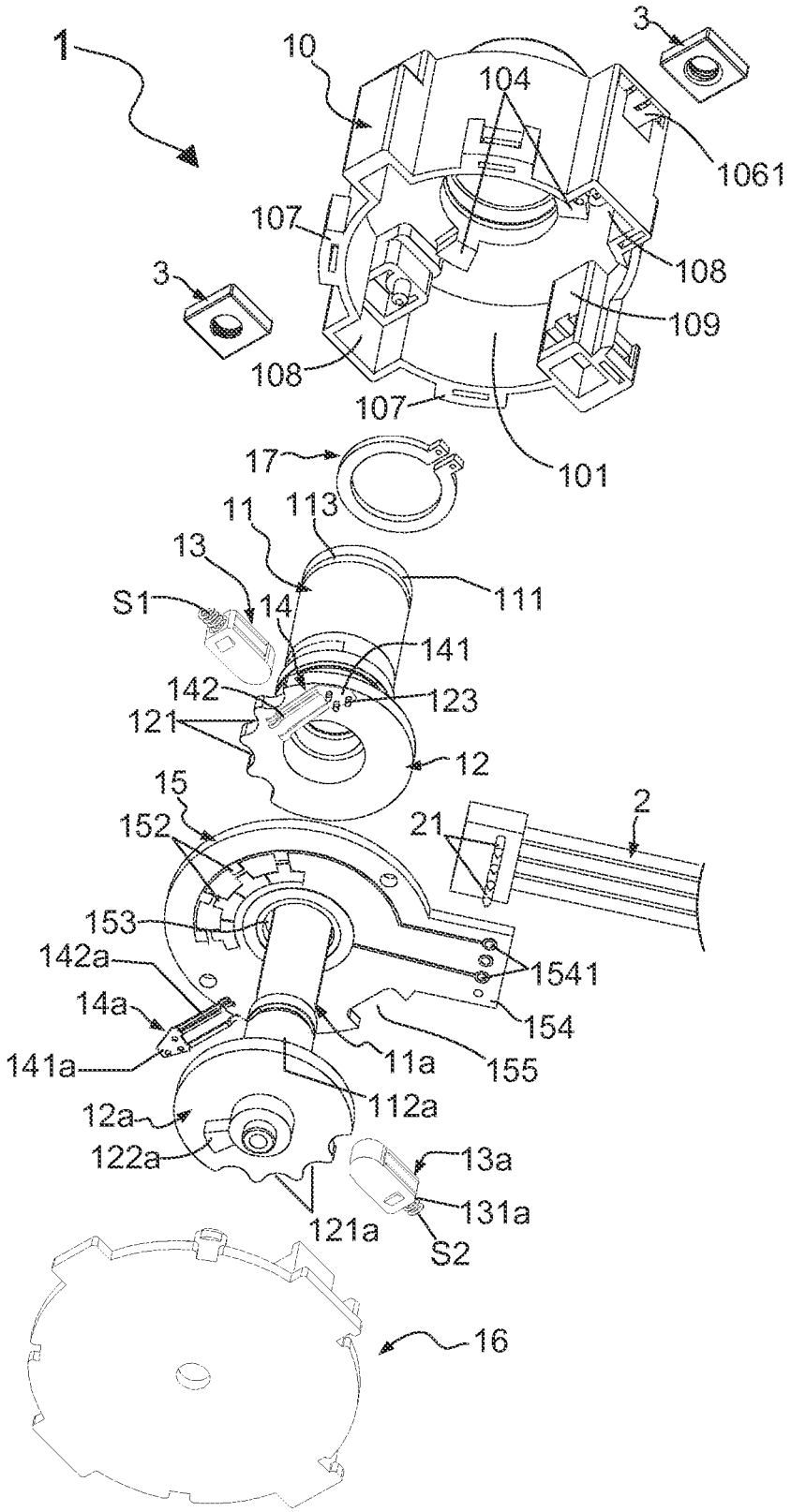

Please simultaneously refer to FIG. 3, FIG. 4, FIG. 5, and FIG. 6, where stereo diagrams of a rotary switch according to the present invention are shown in FIG. 3 and FIG. 4, and exploded diagrams of the rotary switch are shown in FIG. 5 and FIG. 6. As shown by FIG. 3-FIG. 6, the rotary switch 1 consists of: a main covering body 10, a lower cover 16, a first rotary disk 12, a first retaining member 13, a first metal spring 14, an inner shaft 11*a*, a second rotary disk 12*a*, a second retaining member 13*a*, a second metal spring 14*a*, and a double-sided printed circuit board (PCB) 15. In which, the main covering body 10 has an internal accommodating trough 101 in the internal thereof, and a shaft sleeve 102 is extended out from the top of the main covering body 10. Moreover, the lower cover 16 is utilized for being combined with the main covering body 10 so as to shield the internal accommodating trough 101. In the present invention, the main covering body 10 and the lower cover 16 constitute to a switch housing having an exposing aperture 103.

Figure 7:
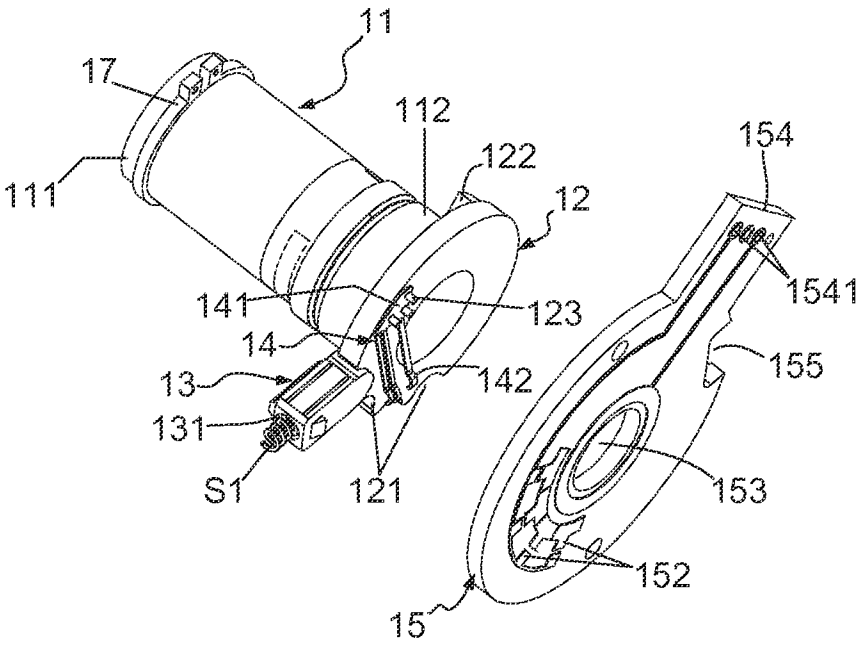
FIG. 7 shows a stereo diagram of a hollow external shaft, a first rotary disk, a first retaining member, a first metal spring, and a double-sided PCB.

Continuously referring to FIGS. 3-6, and please simultaneously refer to FIG. 7, which illustrate a stereo diagram of the hollow external shaft, the first rotary disk, the first retaining member, the first metal spring, and the double-sided PCB. As shown by FIG. 3-FIG. 7, the hollow external shaft 11 is disposed in the internal accommodating trough 101, wherein a first top end 111 of the hollow external shaft 11 is exposed out of the main covering body 10 along the shaft sleeve 102, and a first lower end 112 of the hollow external shaft 11 is connected to the first rotary disk 12. Moreover, the first rotary disk 12 includes: a plurality of first rotary grooves 121 formed around a disk side edge of the first rotary disk 12, a third rotation stopping block 122 disposed on a top surface of the first rotary disk 12, and a first attaching member 123 disposed on a bottom surface of the first rotary disk 12.

In the present invention, the first retaining member 13, having a first spring accommodating trough 131 for receiving a first spring S1, is utilized for embedding into any one of the plurality of first rotary grooves 121, so as to prop and retain the first rotary disk 12 based on the support of a first acting force provided by the first spring S1. Besides, the first metal spring 14 has a first disposing portion 141 and a plurality of first electrical contacting portions 142, wherein the first disposing portion 141 is attached onto a bottom surface of the first rotary disk 12, and the first electrical contacting portions 142 downward extend out from the first disposing portion 141 at a first tilt angle.

Figure 8:
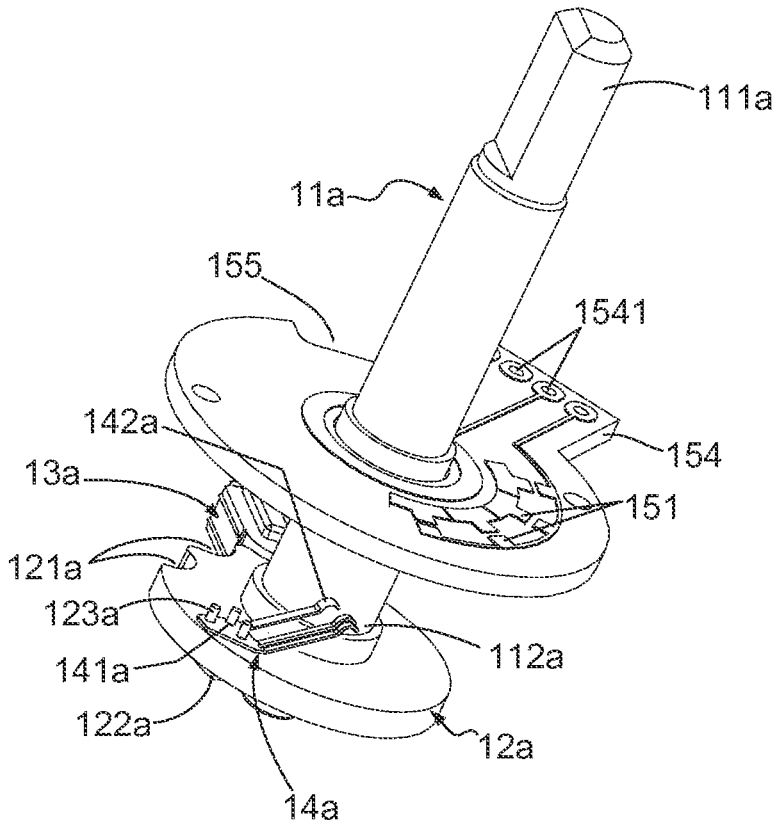
FIG. 8 shows a stereo diagram of an inner shaft, a second rotary disk, a second retaining member, a second metal spring, and the double-sided PCB.

Continuously referring to FIGS. 3-6, and please simultaneously refer to FIG. 8, which illustrate a stereo diagram of the inner shaft, the second rotary disk, the second retaining member, the second metal spring, and the double-sided PCB. As shown by FIGS. 3-6 and FIG. 8, the inner shaft 11*a* is disposed in the hollow external shaft 11, wherein a second top end 111*a* of the inner shaft 11*a* is exposed out of the main covering body 10 along the hollow external shaft 11 and the shaft sleeve 102, and a second lower end 112*a* of the inner shaft 11*a* is connected to the second rotary disk 12*a*. Moreover, the second rotary disk 12*a* includes: a plurality of second rotary grooves 121*a* formed around a disk side edge of the second rotary disk 12*a*, a fourth rotation stopping block 122*a* disposed on a bottom surface of the second rotary disk 12*a*, and a second attaching member 123*a* disposed on a top surface of the second rotary disk 12*a*.

In the present invention, the second retaining member 13*a*, having a second spring accommodating trough 131*a* for receiving a second spring S2, is utilized for embedding into any one of the second rotary grooves 121*a*, so as to prop and retain the second rotary disk 12*a* based on the support of a second acting force provided by the second spring S2. Besides, the second metal spring 14*a* has a second disposing portion 141*a* and a plurality of second electrical contacting portions 142*a*, wherein the second disposing portion 141*a* is attached onto the top surface of the second rotary disk 12*a*, and the second electrical contacting portions 142*a* upward extend out from the second disposing portion 141*a* by a second tilt angle.

Figure 9A:
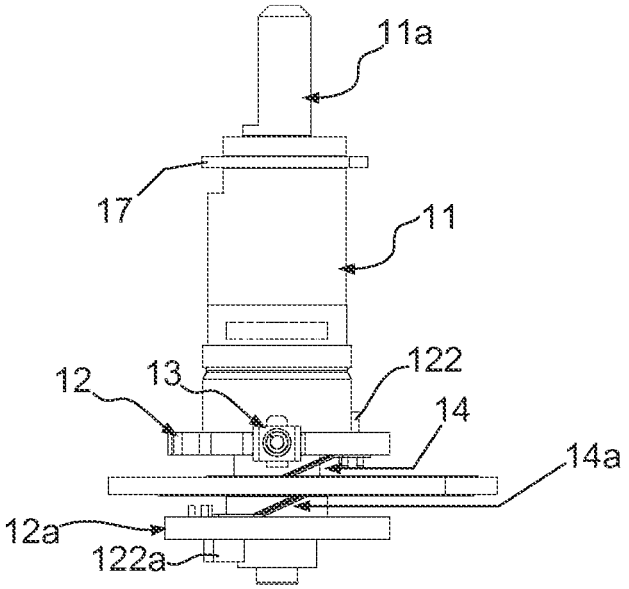
FIG. 9A and FIG. 9B show side views of the hollow external shaft, the first rotary disk, the first retaining member, the first metal spring, the inner shaft, the second rotary disk, the second retaining member, the second metal spring, and the double-sided PCB.
Figure 9B:
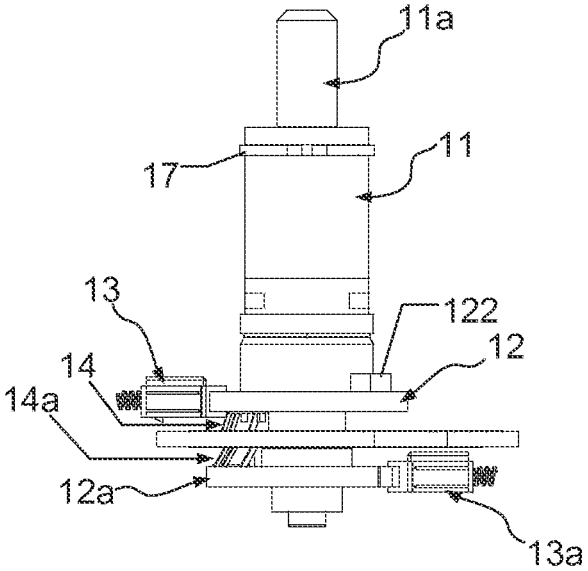

Continuously referring to FIG. 3-FIG. 8, and please simultaneously refer to FIG. 9A and FIG. 9B, there are shown the side views of the hollow external shaft, the first rotary disk, the first retaining member, the first metal spring, the inner shaft, the second rotary disk, the second retaining member, the second metal spring, and the double-sided PCB. As the related drawings show, a plurality of first electrical connecting areas 151 and a plurality of second electrical connecting areas are formed on the top surface and the bottom surface of the double-sided PCB 15; moreover, a center through hole 153 and an electrical connecting region 154 are further provided on the double-sided PCB 15, such that the center through hole 153 sleeves the second lower end 112*a* of the inner shaft 11*a* for making the double-sided PCB 15 between the first rotary disk 12 and the second rotary disk 12*a*. Therefore, the first electrical connecting portions 142 of the first metal spring 14 are able to contact with the first electrical connecting areas 151, and the second electrical connecting portions 142*a* of the second metal spring 14*a* are able to contact with the second electrical connecting areas 152. In addition, the electrical connecting region 154 is exposed out of the switch housing via the exposing aperture 103, such that a plurality of welding points 1541 formed on the electrical connecting region 154 can be welded with a plurality of welding terminals 21 of an external conductive wire set 2.

Figure 10A:
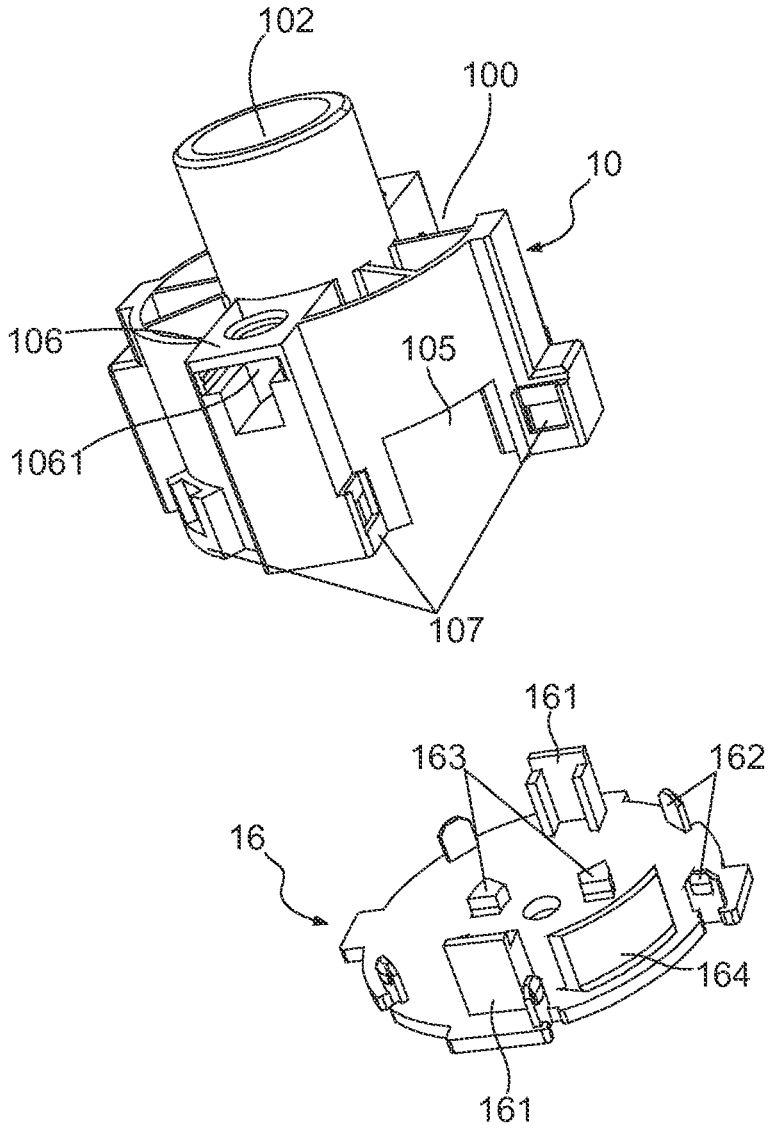
FIG. 10A and FIG. 10B are stereo diagrams of a main covering body and a lower cover.
Figure 10B:
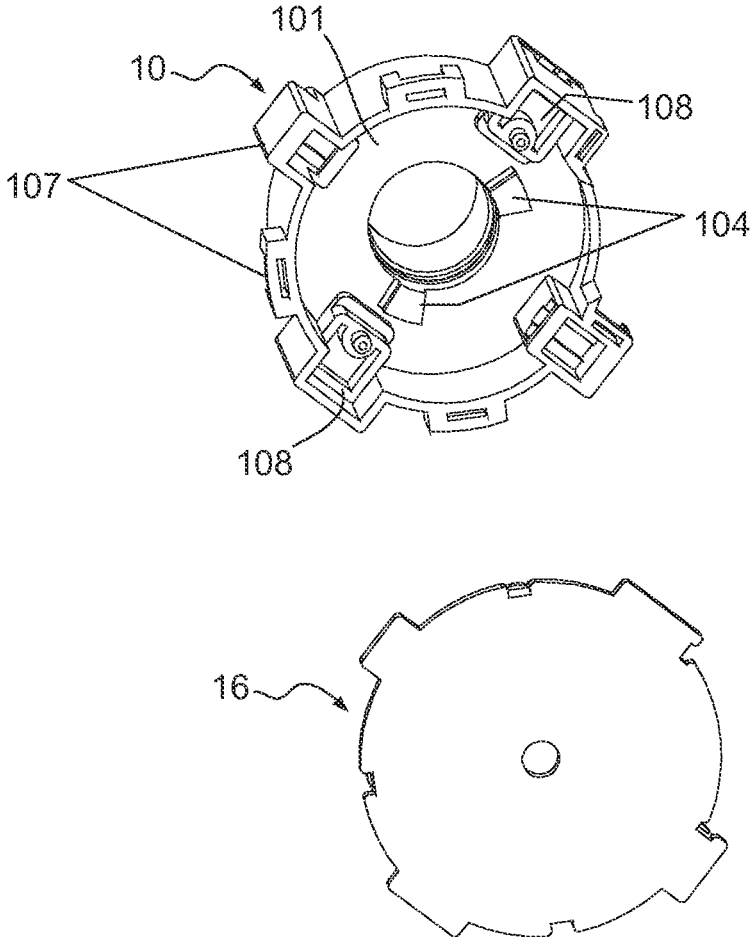

Please further simultaneously refer to the stereo diagrams of the main covering body and the lower cover shown by FIG. 10A and FIG. 10B. In the present invention, the main covering body 10 is designed to include some particular elements of: two first rotation stopping blocks 104 disposed on the bottom of the internal accommodating trough 101, a recess 105 formed on one side of the main covering body 10, two fixing members 106, a plurality of first lock members 107 formed around the side edge of the main covering body 10, and a supporting post 109 formed on one inner sidewall of the internal accommodating trough 101. In which, the first rotation stopping block 104 is used for interworking with the third rotation stopping block 122 disposed on the top surface of the first rotary disk 12, so as to stop the rotation of the first rotary disk 12. On the other hand, the fixing members 106 are disposed on an outer surface of the main covering body 10 and adjacent to the shaft sleeve 102 opposite to each other; wherein each the fixing members 106 has one screw nut space 1061 and one supporting groove 108, and the screw nut space 1061 is used for receiving a tablet-shaped screw nut 3. Therefore, by the interwork of the two tablet-shaped screw nuts 3 in the fixing members 106 and two screw bolts, the rotary switch can be applied in any one electric product.

Opposite to the main covering body 10, the lower cover is designed to include some particular elements of: two supporting members 161 for being respectively inserted to the supporting grooves 108, two second lock members 162 for interlocking with the plurality of first lock member 107, two second rotation stopping blocks 163 disposed on a top surface of the lower cover 16, and a protruding member 164 formed on the top surface of the lower cover 16. In which, the second rotation stopping block 163 is utilized for interworking with the second rotation stopping block 122*a* disposed on the top surface of the second rotary disk 12*a*, so as to stop the rotation of the second rotary disk 12*a*. Besides, the protruding member 164 formed on a top surface of the lower cover 16 is located around a top surface edge of the lower cover 16; as the FIG. 3 and FIG. 5 show, the exposing aperture 103 is constituted by the protruding member 164 and the recess 105.

As shown in FIG. 3, the present invention particularly designs a fool-proofing notch 100 on the top surface of the main covering body 10 and adjacent to the shaft sleeve 102, wherein the said fool-proofing notch 100 is a one-fourth arc notch. Moreover, opposite to the main covering body 10, the double-sided PCB 15 is further provided with a notch 155, such that the supporting post 109 can be embedded into the notch 155 for making the double-sided PCB 15 be disposed in the internal accommodating trough 101 steadily.

Furthermore, as shown in FIG. 4 and FIG. 5, an embedding groove 113 is formed on the first top end 111 of the hollow external shaft 11; therefore, a C-shaped fixing ring 17 can be embedded into the embedding groove 113, and then the C-shaped fixing ring 17 can be utilized for combining with a switching cap by way of accommodating the second top end 111*a* of the inner shaft 11*a* and the first top end 111 of the hollow external shaft 11.

Figure 1:
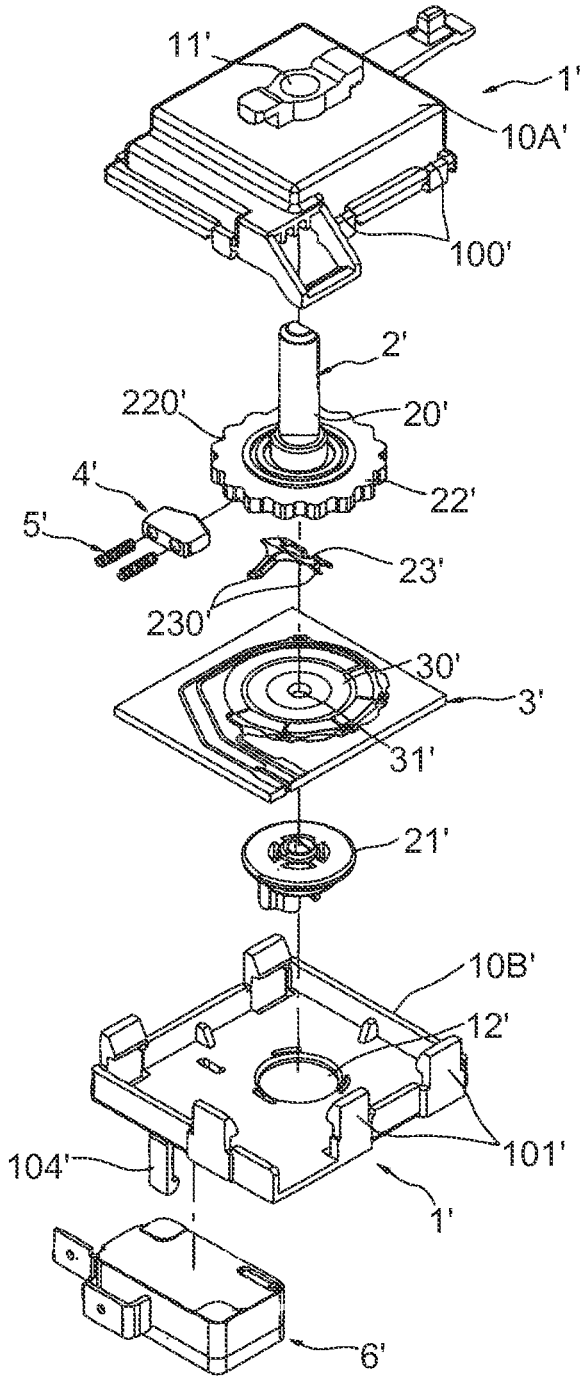
FIG. 1 (Prior Art)
FIG. 1 shows an exploded view of a conventional rotary switch.
Figure 2:
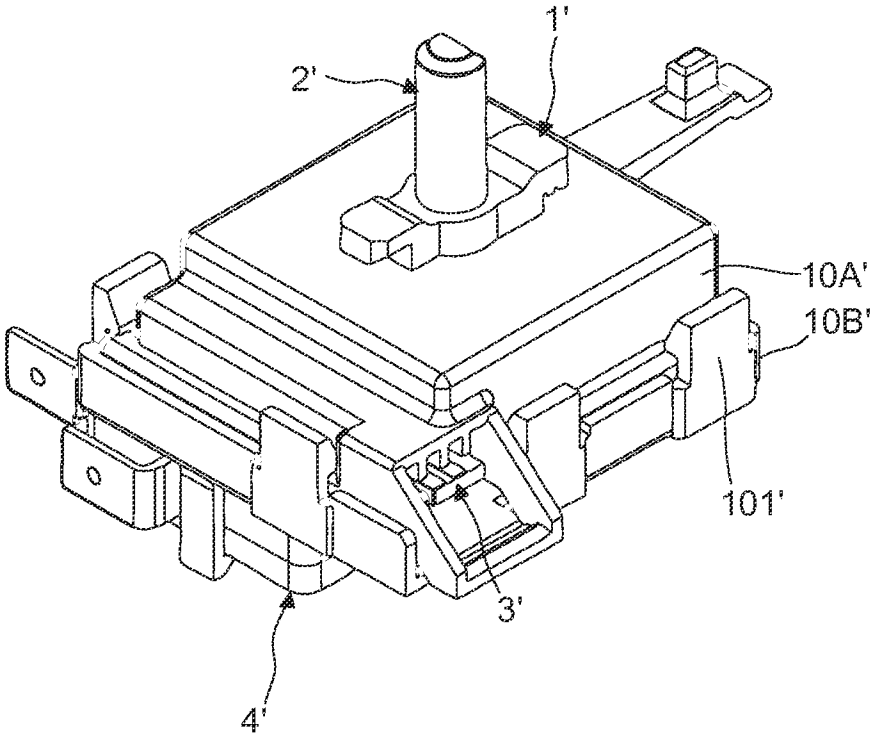
FIG. 2 (Prior Art)
FIG. 2 shows a stereo view of the conventional rotary switch.

Therefore, through above descriptions, the rotary switch 1 proposed by the present invention has been introduced completely and clearly; in summary, the present invention includes the advantages of:

(1) Differing from the conventional rotary switch shown by FIG. 1 and FIG. 2, the rotary switch 1 provided by the present invention is design to perform bidirectional rotation by double shaft, such that this rotary switch 1 has the maximum switching levels of 32 and can be applied in any one electric product or equipment.

(2) Moreover, the present invention particularly design two retaining members (13, 13*a*) having a spring accommodating trough (131, 131*a*) are adopted for accommodating the corresponding compression springs (S1, S2); therefore, when switching the rotary switch 1 from one switching level to another one switching level, each the retaining member (13, 13*a*) does ensured to fully embed into one of the rotary grooves formed around the disk side edge of the corresponding rotary disks (12, 12*a*); the reason is that the compression springs (S1, S2) suffer to pressing force would not bend during switching the rotary switch 1. Therefore, since both the un-bent compression springs (S1, S2) provide uniform acting force to the retaining members (13, 13*a*), the first electrical connecting portions 142 of the first metal spring 14 are able to precisely contact with the first electrical connecting areas 151 and the second electrical connecting portions 142*a* of the second metal spring 14*a* are able to precisely contact with the second electrical connecting areas 152, such that the functions of the electric product can be switch smoothly and completely.

The above description is made on embodiments of the present invention. However, the embodiments are not intended to limit scope of the present invention, and all equivalent implementations or alterations within the spirit of the present invention still fall within the scope of the present invention.

What is claimed is:

1. A rotary switch, comprising:

a main covering body, having an internal accommodating trough, and a shaft sleeve being extended out from a top of the main covering body;

a hollow external shaft, being disposed in the internal accommodating trough, and a first top end of the hollow external shaft extending out of the main covering body along the shaft sleeve;

a first rotary disk, being connected to a first lower end of the hollow external shaft, and a plurality of first rotary grooves being formed around a disk side edge of the first rotary disk;

a first retaining member, having a first spring accommodating trough for receiving a first spring; wherein the first retaining member is able to embed into any one of the plurality of first rotary grooves, so as to prop and retain the first rotary disk based on a support of a first acting force provided by the first spring;

a first metal spring, having a first disposing portion and a plurality of first electrical contacting portions, wherein the first disposing portion is attached onto a bottom surface of the first rotary disk, and each of the plurality of first electrical contacting portions extending downward from the first disposing portion at a first tilt angle;

an inner shaft, being disposed in the hollow external shaft, and a second top end of the inner shaft extending out of the main covering body along the hollow external shaft and the shaft sleeve;

a second rotary disk, being connected to a second lower end of the inner shaft, and a plurality of second rotary grooves being formed around a disk side edge of the second rotary disk;

a second retaining member, having a second spring accommodating trough for receiving a second spring; wherein the second retaining member is able to embed into any one of the plurality of second rotary grooves, so as to prop and retain the second rotary disk based on a support of a second acting force provided by the second spring;

a second metal spring, having a second disposing portion and a plurality of second electrical contacting portions, wherein the second disposing portion is attached onto a top surface of the second rotary disk, and the second electrical contacting portions extending out from the second disposing portion at a second tilt angle;

a double-sided printed circuit board (PCB), wherein a plurality of first electrical connecting areas and a plurality of second electrical connecting areas are formed on a top surface and a bottom surface of the double-sided PCB, and a center through hole and an electrical connecting region being further provided on the double-sided PCB, such that the second lower end of the inner shaft couples to the center through hole, so as to position the double-sided PCB between the first rotary disk and the second rotary disk; and a lower cover, being combined with the main covering body for shielding the internal accommodating trough; wherein the main covering body and the lower cover constitute a switch housing, and the switch housing having an exposing aperture for exposing the electrical connecting region, such that an external conductive wire set is connected to the electrical connecting region.

2. The rotary switch of claim 1, wherein a plurality of welding points are formed on the electrical connecting region to be welded to a plurality of welding terminals of the conductive wire set.

3. The rotary switch of claim 1, further comprising a C-shaped fixing ring, being embedded into an embedding groove formed on the first top end of the hollow external shaft.

4. The rotary switch of claim 1, wherein the main covering body further comprises:

at least one first rotation stopping block, being disposed on a bottom of the internal accommodating trough;

a recess, being formed on one side of the main covering body;

at least two fixing members, being disposed on an outer surface of the main covering body, and adjacent to the shaft sleeve opposite to each other; wherein each of the at least two fixing members has one screw nut space and one supporting groove, and the screw nut space being used for receiving a tablet-shaped screw nut;

a plurality of first lock members, being formed around a side edge of the main covering body; and a supporting post, being formed on one inner sidewall of the internal accommodating trough.

5. The rotary switch of claim 4, wherein a notch is provided on a top surface of the main covering body and adjacent to the shaft sleeve, and the notch is a one-fourth arc notch.

6. The rotary switch of claim 4, wherein the double-sided PCB further comprises a notch, and the supporting post is embedded in the notch for stabilizing the double-sided PCB in the internal accommodating trough.

7. The rotary switch of claim 4, wherein the lower cover further comprises:

at least two supporting members, being inserted into a corresponding supporting groove;

at least one second lock member, being interlocked with the plurality of first lock member;

at least one second rotation stopping block, being disposed on a top surface of the lower cover; and a protruding member, being formed on the top surface of the lower cover and located around a top surface edge of the lower cover; wherein the exposing aperture is constituted by the protruding member and the recess.

8. The rotary switch of claim 7, wherein the first rotary disk further comprises:

a third rotation stopping block, being disposed on a top surface of the first rotary disk; wherein a rotation of the first rotary disk is stopped by a cooperation of the at least one first rotation stopping block and the third rotation stopping block; and a first attaching member, being disposed on a bottom surface of the first rotary disk, and used for connecting to the first disposing portion so as to attach the first metal spring onto the bottom surface of the first rotary disk.

9. The rotary switch of claim 8, wherein the second rotary disk further comprises:

a fourth rotation stopping block, being disposed on a top surface of the second rotary disk; wherein a rotation of the second rotary disk is stopped by a cooperation of the second rotation stopping block and the fourth rotation stopping block; and a second attaching member, being disposed on a bottom surface of the second rotary disk, and used for connecting with the second disposing portion so as to attach the second metal spring onto the bottom surface of the second rotary disk.

* * * * *